US007218576B1

(12) United States Patent
Bron

(10) Patent No.: US 7,218,576 B1
(45) Date of Patent: May 15, 2007

(54) ANNUAL CALENDAR MECHANISM FOR WATCH MOVEMENT

(75) Inventor: Alphonse Bron, Bassecourt (CH)

(73) Assignee: ETA SA Manufacture Horlogére Suisse, Grenchen (CH)

( * ) Notice: Subject to any disclaimer, the term of this patent is extended or adjusted under 35 U.S.C. 154(b) by 0 days.

(21) Appl. No.: 11/558,028

(22) Filed: Nov. 9, 2006

(51) Int. Cl.
*G04B 19/20* (2006.01)
*G04B 19/24* (2006.01)

(52) U.S. Cl. ..... 368/35; 368/37

(58) Field of Classification Search ..... 368/28, 368/35–38
See application file for complete search history.

(56) References Cited

U.S. PATENT DOCUMENTS 4,026,100 A 5/1977 Kume et al.
4,198,808 A * 4/1980 Tamaru ..... 368/37
6,295,250 B1 * 9/2001 Ray et al. ..... 368/37

FOREIGN PATENT DOCUMENTS

CH 651 440 A3 9/1985
EP 0 987 609 A1 3/2000

OTHER PUBLICATIONS

European Search Report issued in corresponding application No. EP 05 02 4628 completed Sep. 18, 2006.

* cited by examiner

*Primary Examiner*—Vit W. Miska
(74) *Attorney, Agent, or Firm*—Griffin & Szipl, P.C.

(57) ABSTRACT

The invention concerns an annual calendar mechanism for a timepiece including a date disc (16) to which are thirty one figures are affixed each corresponding to an indication of a day of the month provided with a first inner toothing (20) including thirty one teeth (20*a*), a date drive wheel set (32), said wheel set (32) including a finger (34) driving the date disc (16) through one step per day via one of the teeth (20*a*) of the first inner toothing (20) in order to control the date display, said date disc (16) including a second toothing (24), a correction drive wheel set (42) able to cooperate with the second toothing (24) to drive the date disc (16) through an additional step at the end of the months of less than thirty one days, and a month star wheel (54) arranged to be actuated at the end of each month and to complete one revolution per year, characterized in that in includes a month drive wheel set (52) provided for driving the month star wheel (54) at the end of each month, said drive wheel set (52) being connected, via a gear train (35, 56), to the date drive wheel set (32) and to the additional correction drive wheel set (42), said wheel set (52) occupying a first position in which it has no effect on the month star wheel (54), such that the kinematic chain between the date disc (16) and the month star wheel (54) is broken, and a second position that it occupies only at the moment when the change of month occurs and in which it actuates the month star wheel (54) so as to move it one step forward, such that a correction device (90) can act on the date disc (16) without any effect on the month star wheel (54) and vice versa.

14 Claims, 16 Drawing Sheets

ANNUAL CALENDAR MECHANISM FOR WATCH MOVEMENT

This application claims priority from European Patent Application No. 05024628.9 filed Nov. 11, 2005, the entire disclosure of which is incorporated herein by reference.

FIELD OF THE INVENTION

The present invention concerns an annual calendar mechanism for a watch movement associated with a month indicator mechanism. This type of calendar mechanism display the exact day of the month, performing a single correction per year of one or two days to change the date to the first of March at the end of the month of February.

BACKGROUND OF THE INVENTION

An annual calendar mechanism for a watch movement is disclosed in EP Patent No. 0 987 609 in the name of Frédéric Piguet. According to this Patent, the mechanism comprises a date disc provided with thirty one inner teeth located at a first level and to which thirty one figures are affixed, each corresponding to an indication of the day of the month, these figures appearing in succession through an aperture arranged in a dial. A drive wheel set for the date disc comprises a drive wheel that is connected via an intermediate wheel set to the hour wheel of the watch movement. This drive wheel set, fitted with a drive finger, completes one revolution in twenty-four hours and is able to drive the date disc through one step once per day via its inner toothing to control the date display.

The Piguet mechanism further comprises a device for correcting the date indication at the end of each of the months of less than thirty-one days. The date disc therefore comprises a second toothing secured to the date disc and located at a second level. This additional toothing is provided with two juxtaposed teeth spaced from each other by a thirty first of a revolution and drives once a month a wheel which carries a month cam via two intermediate wheels. The month cam is arranged to be actuated at the end of each month by the additional tooth and to make one revolution per year. It carries fine teeth corresponding to the months of less than thirty one days, each of these teeth being arranged to be at the end of the months of less than thirty one days, on the path of the beak of a lever. This lever carries a correction wheel set fitted with a correction finger able to cooperate with the second toothing at the end of the months of less than thirty one days to drive the date disc through an additional step at the end of these months of less than thirty one days when the lever pivots following the passage of its beak over a tooth of the month cam. The correction wheel set is arranged, like the date drive wheel set, to complete one revolution in twenty-four hours.

The mechanism as described has several drawbacks. First of all, the month cam, which includes indications identifying the months of the year and appearing in succession through an aperture pierced in the watch dial, is driven, as has just been seen, by a toothing secured to the date disc. Consequently, it is impossible to correct the month indication without having simultaneously to act on the date mechanism. This can be inconvenient when the watch has, for example, stopped on the $10^{th}$ day of a given month and when one wishes to reset it to the correct date on the $15^{th}$ day of the following month. In such case, one would have to scroll down in succession all of the numbers corresponding to the date indications from the "$11^{th}$", to the "$31^{st}$" then from the "$1^{st}$" to the "$15^{th}$".

Moreover, as has also been seen, the device for correcting the date indication at the end of each of the months of less than thirty one days requires a second toothing to be provided on the date disc, provided with two juxtaposed teeth separated from each other by a thirty first of a revolution. The month cam is arranged to be actuated in succession by each of these two teeth by moving forward by one twenty fourth of a revolution each time. If a quick correction device were used, one would not be able to determine which of the two teeth of the second toothing of the date disc was about to actuate the month cam, such that a phase shift would be liable to occur between the date display and the month indication. This quick correction mechanism therefore cannot be employed in the annular calendar mechanism disclosed in the Piguet Patent.

Finally, the Piguet mechanism cannot be used with an instantaneous calendar device. Thus, referring to the Figures of the Piguet Patent, it can be seen that at midnight on the $30^{th}$ of a month of thirty days, the date ring indicates the $31^{st}$. Consequently, during a time period that extends from 21h00 on the "$30^{th}$" of a month of 30 days and 02h30 on the "$1^{st}$" day of the month following the month of thirty days, the date indication provided by the watch is incorrect.

It is an object of the present invention to overcome the aforementioned drawbacks in addition to others by providing an annual date mechanism for a watch movement which, in particular, can be corrected simply and quickly.

SUMMARY OF THE INVENTION

The invention therefore concerns an annual calendar mechanism for a timepiece comprising a date disc to which thirty one figures are affixed, each corresponding to an indication of a day of the month and fitted with a first inner toothing comprising thirty one teeth, a date drive wheel set, this wheel set including a finger driving the date disc through one step once per day via one of the teeth of the first inner toothing to control the date display, said date disc comprising a second toothing, an additional correction drive wheel set able to cooperate with the second toothing to drive the date disc through one additional step at the end of the months of less than thirty one days and a month cam arranged to be actuated at the end of each month and to complete one revolution per year, characterized in that it includes a month drive wheel set provided for driving the month cam at the end of each month, said drive wheel set being connected, via a gear train, to the date drive wheel set and to the correction drive wheel set, said wheel set occupying a first position in which it has no effect on the month cam such that the kinematic chain between the date disc and the month cam is broken, and a second position that it only occupies at the moment when a change of month occurs and in which it actuates the month cam so as to move it forward one step.

Owing to these features, the present invention provides an annual date mechanism in which the date disc is not kinematically connected to the month cam, except during the time interval necessary for the mechanism to pass from the end of one month to the start of the next month. Correction of the month can thus be made independently of the date correction. It can thus be achieved much more quickly than in the case where the date disc is permanently connected to the month cam and where the date has to be rotated through thirty one days in order to correct the month indication.

According to a complementary feature of the invention, the date drive wheel set, the correction drive wheel set and the month drive wheel set are driven by an instantaneous release mechanism.

Owing to this other feature, the present invention provides an annual calendar mechanism in which the date and month indications are corrected quasi instantaneously. The user can thus barely see the display correction steps. Moreover, the watch fitted with the date mechanism according to the invention permanently provides an exact indication of the date and month. This is particularly well appreciated at a change from a month of less than thirty-one days to the first day of the next month. Indeed, as described above, in the case of annual calendar watches of the prior art, correction of the display occurs gradually, in a manner known as sliding in the horological field, and takes several tens of minutes, or even several hours to complete. During this time period, the watch provides incorrect data and month indications. Conversely, according to the invention, these indications are corrected instantaneously, such that the watch always provides the user with correct indications.

BRIEF DESCRIPTION OF THE DRAWINGS

Other features and advantages of the present invention will appear more clearly upon reading the following detailed description of an embodiment of the annual calendar mechanism according to the invention, this example being given purely by way of non limiting illustration, with reference to the annexed drawing, in which.

DETAILED DESCRIPTION OF ILLUSTRATIVE EMBODIMENTS

The present invention proceeds from the general inventive idea that consists in providing an annual calendar mechanism in which the kinematic chain between the date disc and the month star wheel is constantly interrupted except during the period of time necessary for the mechanism to pass from the last day of a month to the first day of the following month, which allows the date indication and the month indication to be corrected more quickly and in an independent manner for example at the end of the month of February or after the watch has been stopped for an extended period. Moreover, the annual calendar mechanism according to the invention includes an instantaneous release system which allows the date and month indication to pass from the end of one month to the beginning of the next month abruptly without dragging such that, for the user, the passage from one month to the next month occurs almost imperceptibly and the watch always provides correct indications.

Figure 1:
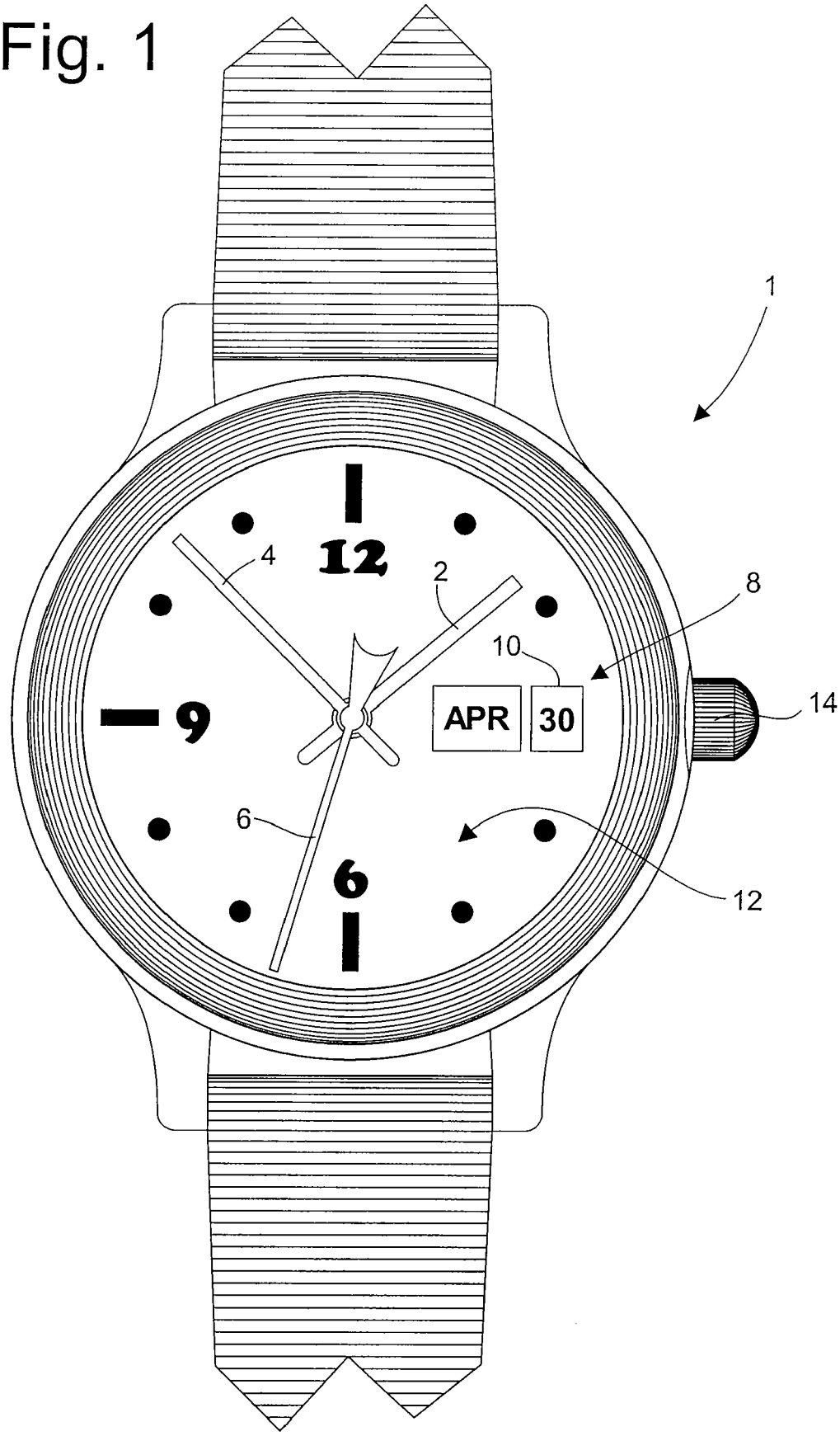
FIG. 1 is a plan view of a watch fitted with an annual calendar mechanism according to the invention.

FIG. 1 is a plan view of a watch fitted with an annual calendar mechanism according to the invention. Designated as a whole by the general reference numeral 1, this watch is fitted in particular with an hour hand 2, a minute hand 4 and second hand 6. It also includes a date indicator in the form of a date 8 appearing through an aperture 10 pierced in a dial 12. Time setting can be performed via a crown 14.

If the dial is now removed from this watch and one keeps only those elements useful for the implementation of the invention, one is left with the plan views of FIGS. 2 to 5, which show the annual calendar mechanism according to the invention at three different instants during the passage from a month of less than thirty one days to the following month, in the example illustrated from the 30$^{th}$ April to the 1$^{st}$ May.

Figure 2:
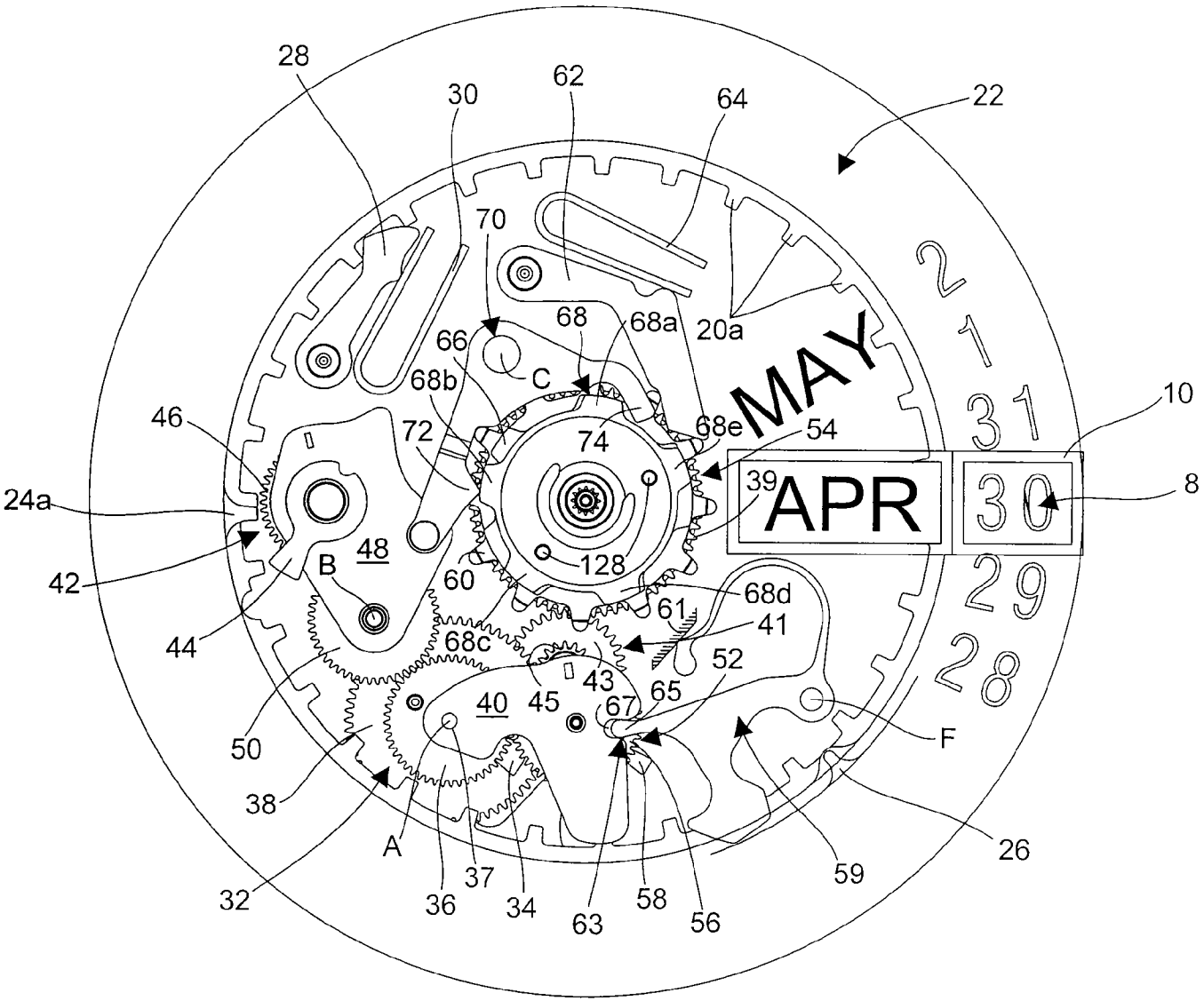
FIG. 2 is a plan view of the annual date mechanism according to the invention in a position preceding the passage of the date disc from the "30$^{th}$" to the "31$^{st}$" at the end of month of less than thirty-one days.
Figure 6:
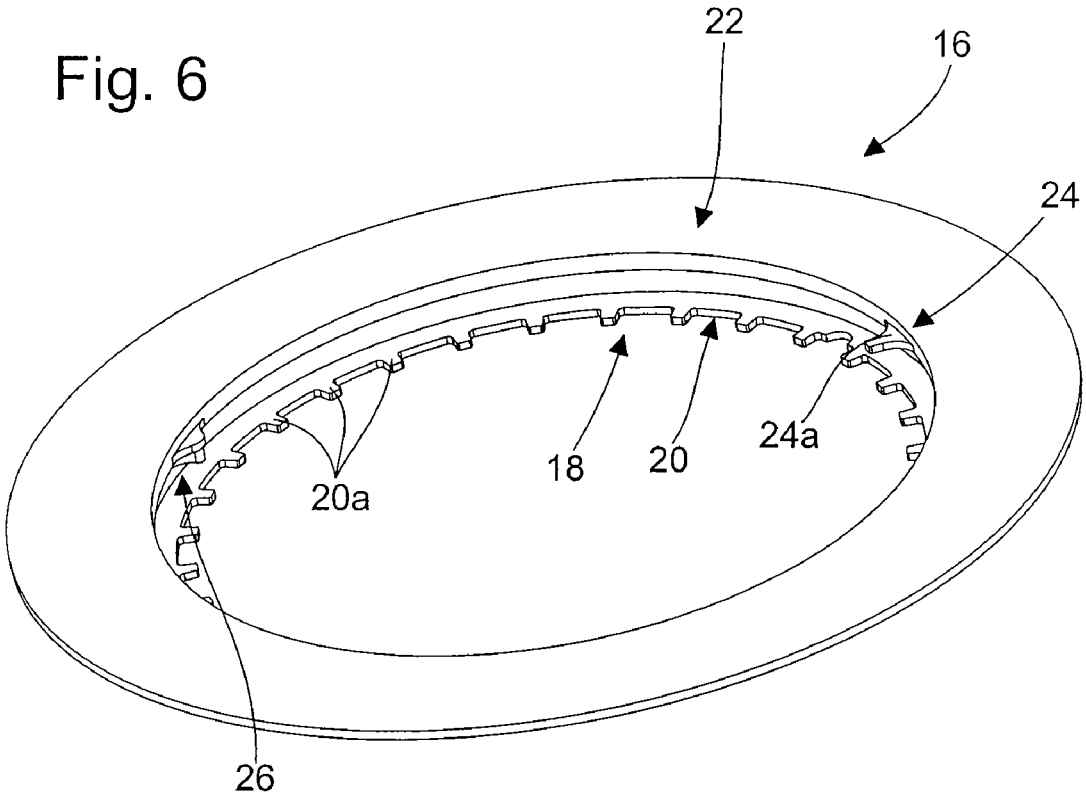
FIG. 6 is a perspective view of the date disc.

An examination of FIG. 2 and of the perspective view of FIG. 6 will explain the operation of the annual calendar mechanism according to the invention. This mechanism comprises a date disc 16 formed of a bottom annular disc 18 carrying a first inner toothing 20 and a top annular disc 22 carrying a second inner toothing 24. The first toothing 20 comprises thirty-one teeth 20*a* whereas the second toothing 24 comprises a single tooth 24*a*. The top face of annular disc 22 carries thirty-one numbers each corresponding to an indication of a day of the month. These numbers appear in succession through aperture 10 shown in FIG. 1. Annular disc 22 also carries on its bottom face a control member 26 of the post type which can be affixed to said annular disc 22 by any appropriate means or which can be integral with said disc 22. The role of this post 26 will be explained in detail hereinafter. Teeth 20*a* and tooth 24*a* consequently extend in two different planes, teeth 20*a* extending below tooth 24*a*. As can be seen upon examining FIG. 6, the two bottom 18 and top 20 annular discs extend parallel to and at a distance from each other.

In FIGS. 2 to 5, it can also be seen that a jumper 28 returned by a spring 30 is applied against toothing 20 of disc 18 in order to position date disc 16 angularly when the latter is not being actuated, allowing perfect indexing of the date disc 16 opposite aperture 10.

A date drive wheel set, generally designated by the reference numeral 32 is fitted with a finger 34 capable of driving date disc 16 through one step once a day via its inner toothing 20. In the particular case of FIG. 2 in which the date mechanism according to the invention is shown in a state immediately preceding the jump from the "30$^{th}$" to the "31$^{st}$" it can be seen that finger 34 is not yet meshed with inner toothing 20 of bottom annular disc 18. As can be seen upon examining FIGS. 2 to 5 and also in FIGS. 7 and 8, the date drive wheel set 32 includes a wheel 36 which carries finger 34 and which is driven in rotation by a first drive wheel 38 completing one revolution per day. This drive wheel 38 is itself driven by the hour wheel 39 of a conventional watch movement, which may be mechanical or electromechanical, via a wheel set 41 whose wheel 43 is driven by hour wheel 39 and whose pinion 45 meshes with drive wheel 38. The date drive wheel set 32 thereby formed pivots on a post 37 secured in movement at A. It could also pivot in a bearing (jewel).

With the exception of the structure of the date disc 16, the foregoing description is well known in the state of the art. It is in fact a conventional date disc drive able to be reset to the date by means of a quick correction device meshed with toothing 20 using a crown when the latter is in a determined position. According to this conventional system, it is necessary to reset the date at the end of months having less than thirty-one days, namely the months of February, April, June, September and November.

We will now describe what has been added to this mechanism to transform it into an annual calendar mechanism in which, apart from for the end of the month of February, the date jumps automatically from the "30$^{th}$" to the "1$^{st}$" of the following month at the end of the months of less than thirty-one days.

As was already mentioned above, the date disc 16 according to the invention differs from a conventional date disc in that it comprises the additional tooth 24*a* provided on the top annular disc 22. It is to be driven once per month, typically at the end of the months of less than thirty-one days, by a correction drive wheel set 42. This wheel set 42 is comprised of a finger 44 secured to a second drive wheel 46, which is carried by a sliding pinion 48 pivoting at B. The second drive wheel 46 is driven by the first drive wheel 38 via an intermediate wheel 50, which meshes with wheel 36.

A sliding lever 40 also carries a month drive wheel set 52 for driving a month star wheel 54 at the end of each month. For this purpose, the month drive wheel set 52 comprises a third drive wheel 56, which carries a finger 58 and which is driven by the first drive wheel 38 via wheel 36. As described in detail hereinafter, a coupling lever 59 pivoting at F controls the pivoting of sliding lever 40. This lever 59 is returned by a spring 61 and cooperates with sliding lever 40 via a maneuvering arm 63 whose head 65 slides into a shaped aperture 67 arranged in said lever 40.

Figure 9:
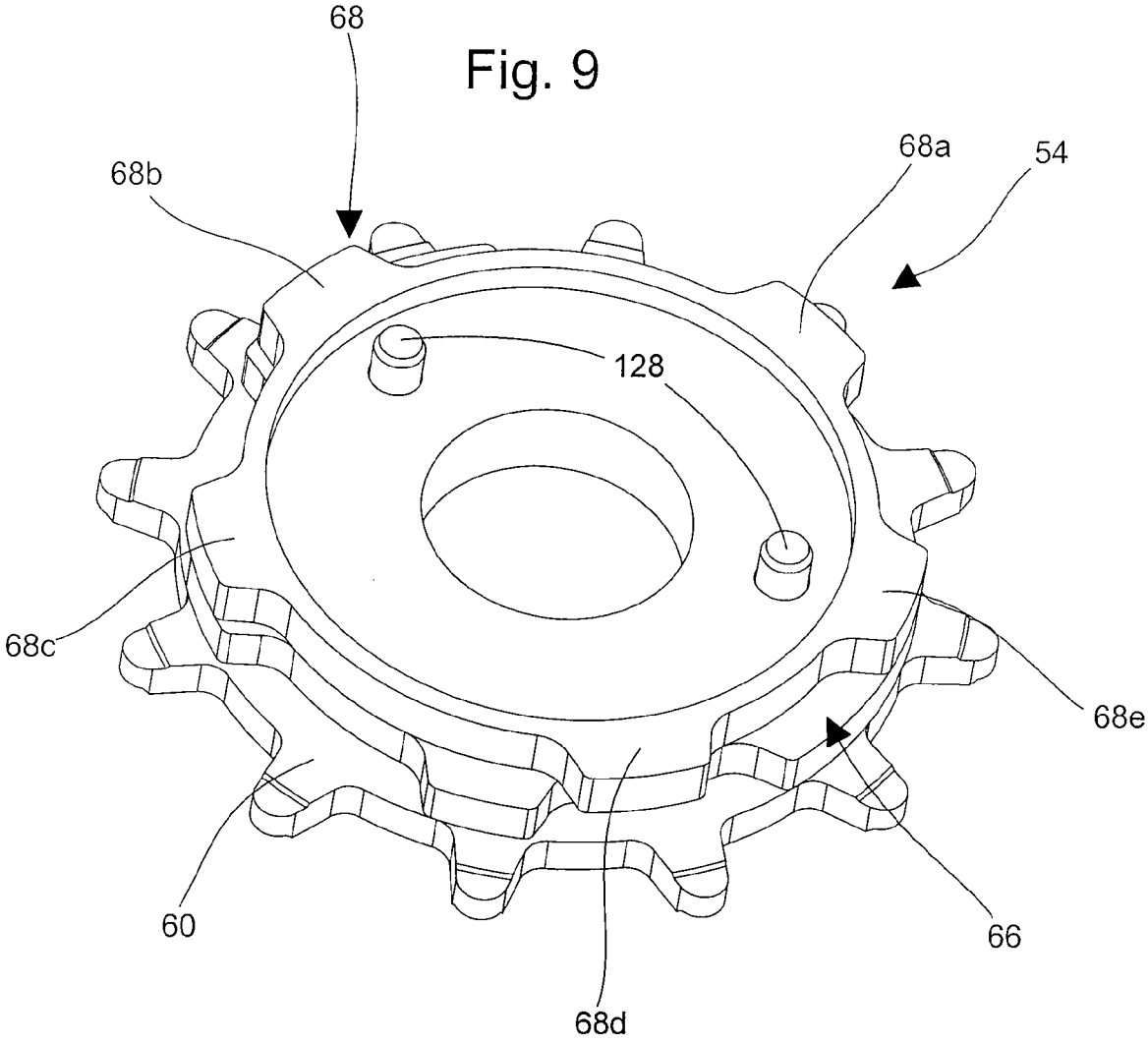
FIG. 9 is a perspective view of the month star wheel.

As is particularly clear in FIG. 9, the month star wheel 54 comprises a wheel with twelve teeth 60, which is positioned by a jumper 62 returned by a spring 62 in order to position said month star wheel 54 angularly when it is not being actuated. This month star wheel 54 also includes a bottom cam 66 and a top cam 68. The top cam 68 includes five protruding portions 68*a*–68*e* distributed at its periphery, these five protruding portions 68*a*–68*e* respectively corresponding to the five months of the year that have less than thirty one days. Bottom cam 66 avoids the use of a return spring for a lever 70, which, via its beak 74, follows the profile of the bottom cam 66 whereas it follows the profile of top cam 68 via its nose 72. This lever 70 pivots at C and is mounted to pivot freely on sliding lever 48.

As the various constituent elements of the invention have been defined above, there remains the explanation of the operation of the annual calendar mechanism. Two cases can arise depending upon whether it is a month of less than thirty-one days or a month of thirty-one days. Passage from the "30$^{th}$" to the first day of the next month in the case of a month of less than thirty-one days is illustrated in FIGS. 2 to 5.

In FIG. 2, the annual calendar mechanism according to the invention is shown in the position that it occupies immediately before passage from the "30$^{th}$" to the "31$^{st}$". In this position, fingers 34 and 44 are released from the first and second bottom toothings 20 and 24 of the bottom and top annular discs 18 and 22. Likewise, finger 58 is released from the toothing of the wheel with twelve teeth 60 of month star wheel 54. Quick correction of the date disc 16 or month star wheel 54 is thus possible at any time because of the use of an instantaneous release system 76 and not a dragging correction system whose peculiarity lies in the fact that the correction fingers gradually penetrate the toothings of the date ring and the month star wheel.

Figure 7:
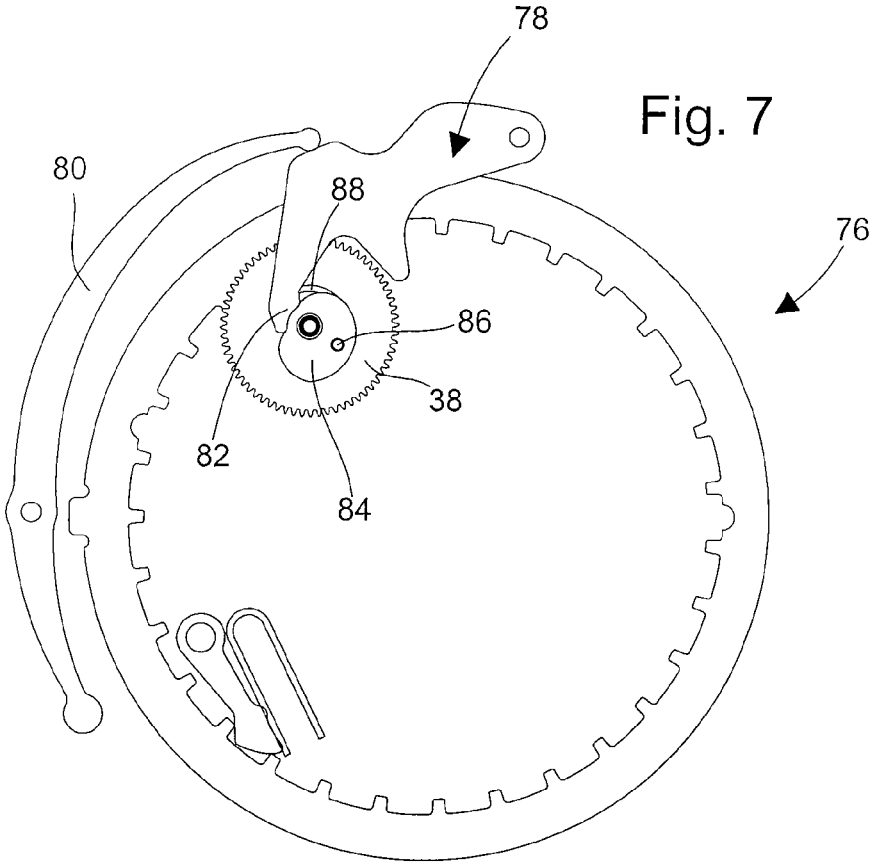
FIG. 7 is a bottom plan view of the instantaneous release system.
Figure 8:
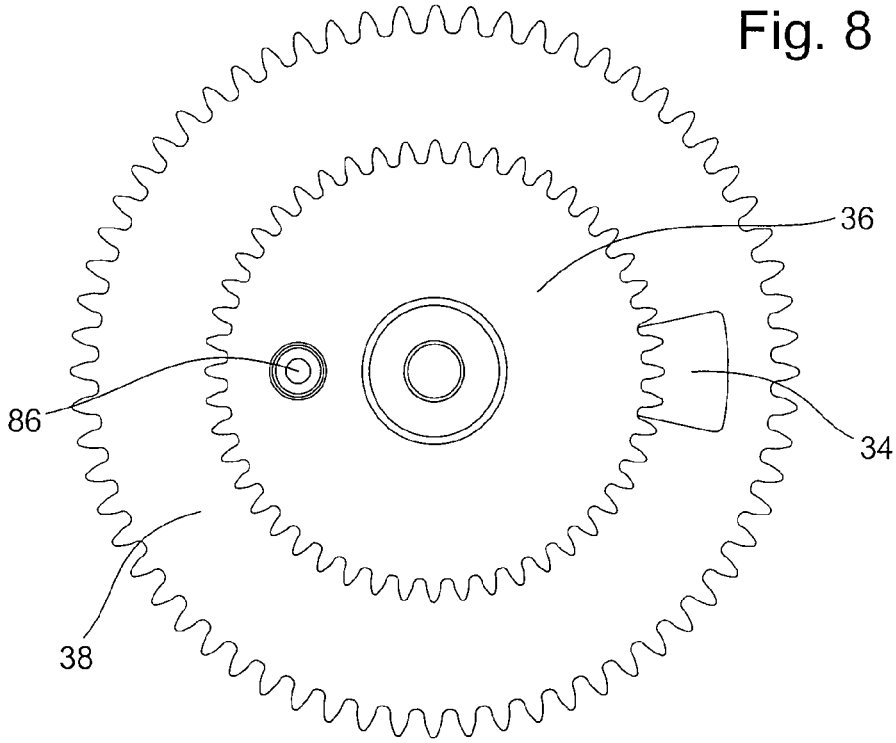
FIG. 8 is a top plan view of the drive wheel of the instantaneous release system.

Instantaneous release system 76 is shown in FIGS. 7 and 8. It comprises in particular the first drive wheel 38 and wheel 36 carrying finger 34. It also comprises a release lever 78 returned by a spring 80 and which abuts via its beak 82 against a cam 84. Wheel 36 is secured to cam 84 via a pin 86 or by rivets. This pin 86 is free to move in a shaped aperture 88 made in drive wheel 38.

The instantaneous release system 76 operates as follows. By rotating, drive wheel 38 drives, via pin 86, wheel 36 and cam 84. The release lever 78 follows the profile of cam 84 via its beak 82 until a point where, constrained by spring 80, it starts to slide abruptly along said cam 84, driving the latter and wheel 36 in rotation at an angle determined by the shape of cam 84. Then, cam 84 and wheel 36 remain still until drive wheel 38 starts to drive them again via pin 86 which is at the bottom of shaped aperture 88.

Figure 3:
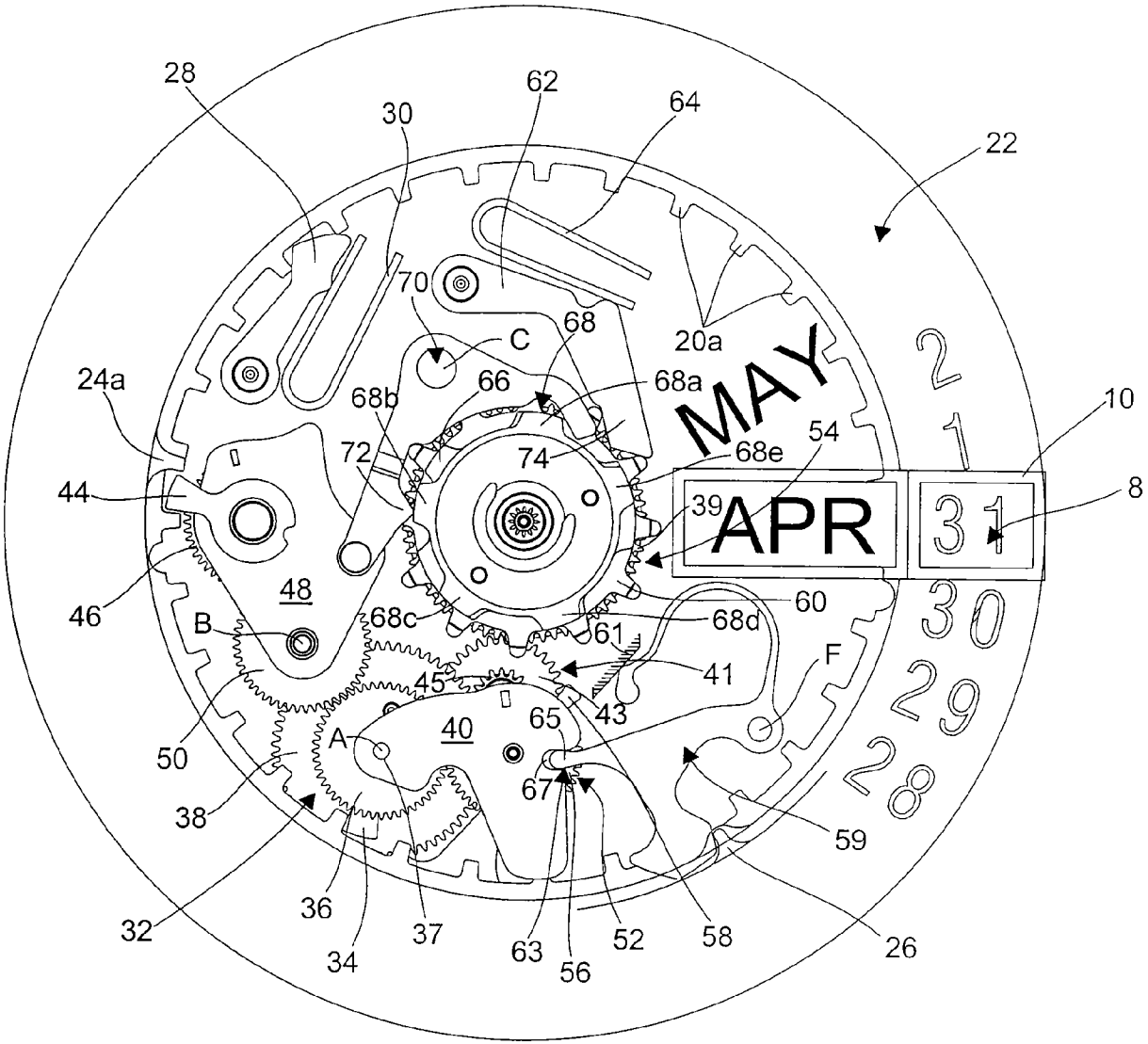
FIG. 3 is a similar view to that of FIG. 2, with the annual calendar mechanism according to the invention passing from the "30$^{th}$" to the "31$^{st}$" at the end of a month of less than thirty-one days.
Figure 4:
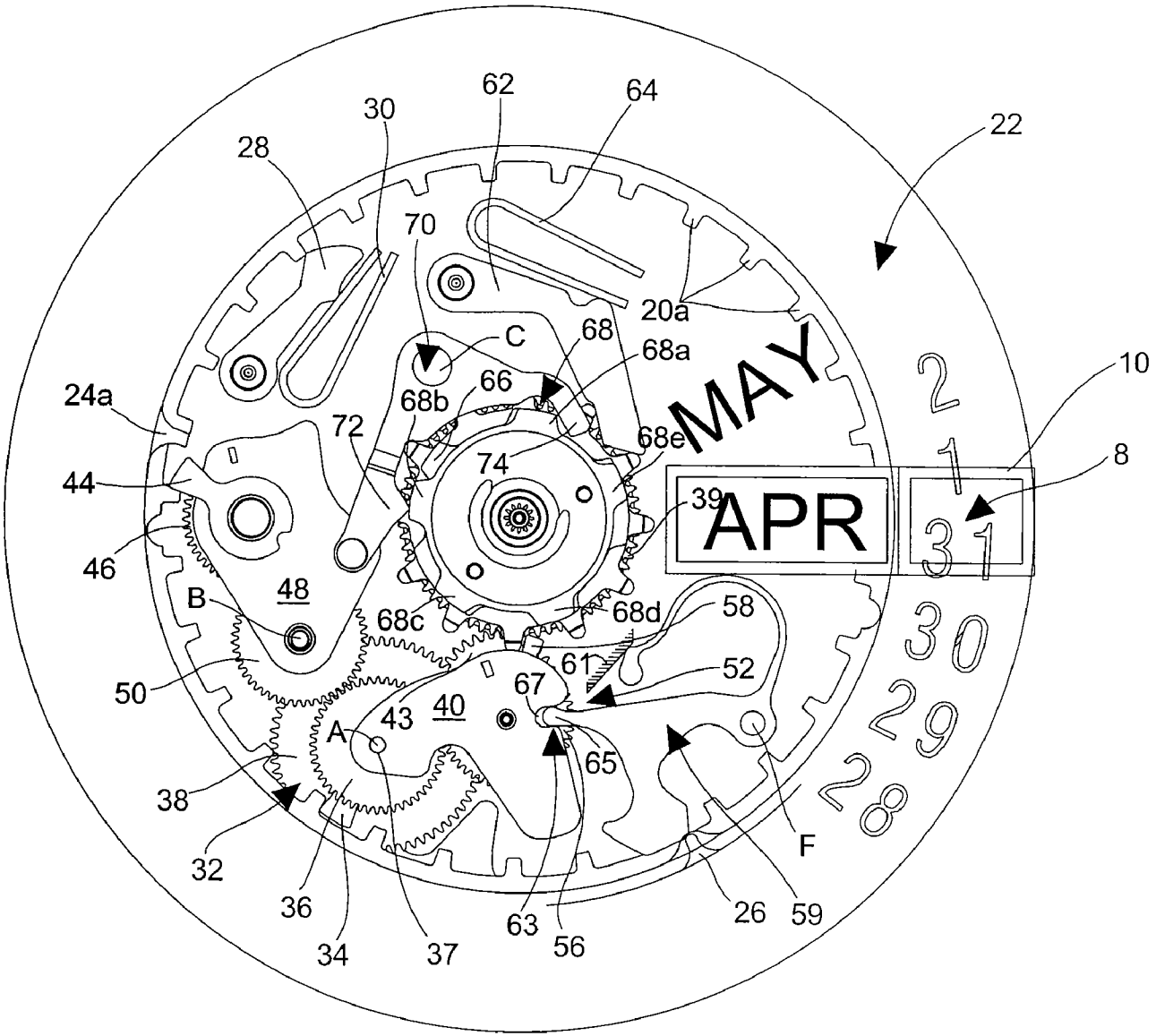
FIG. 4 is a similar view to that of FIG. 3, with the date mechanism according to the invention preparing to pass from the "31$^{st}$" to the first day of a month of thirty-one days.
Figure 5:
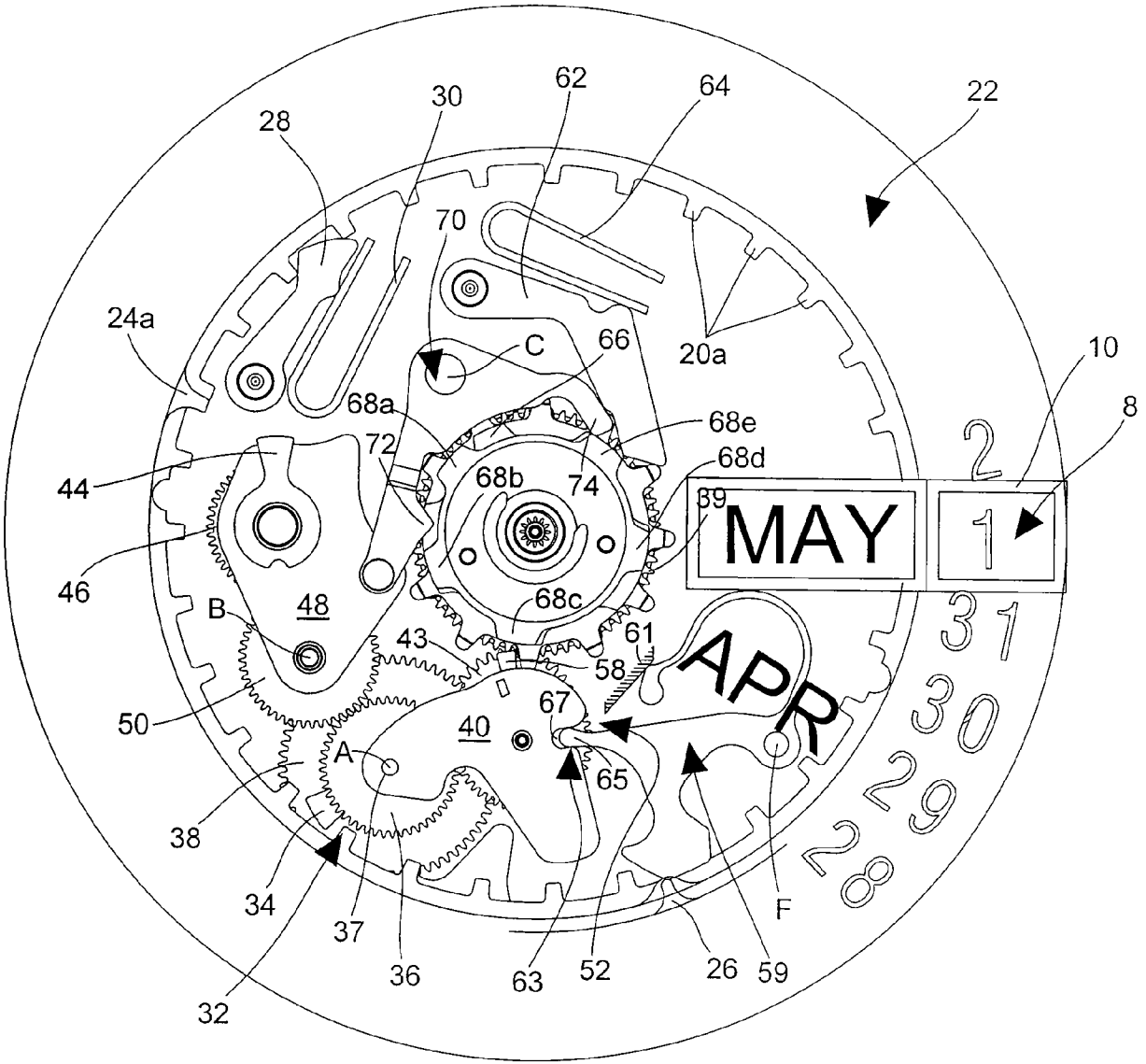
FIG. 5 is a similar view to that of FIG. 4, with the annual calendar mechanism according to the invention at the first day of a month of thirty-one days.

After instantaneous release system 76 has been released, the date mechanism passes in succession through the positions illustrated in FIGS. 3, 4 and 5. It will be understood that the sequence of movement of the various members forming the date mechanism according to the invention has been broken down in order to facilitate comprehension, but that, in reality, the mechanism passes from the position illustrated in FIG. 2 to that illustrated in FIG. 5 in a fraction of a second.

In FIG. 3, finger 44, carried by the second drive wheel 46, which is itself driven by cam 84 and wheel 36 via intermediate wheel 50, has pushed tooth 24*a* through one step and has driven date disc 16 to make the display pass from the "30$^{th}$" to the "31$^{st}$". Wheel 36, driven by instantaneous drive system 76 to which the first drive wheel 38 belongs, continues to rotate, such that finger 34, carried by said wheel 36, is behind a tooth 20*a* of bottom annular disc 18 and the second operating phase of the mechanism illustrated in FIG. 4 can begin.

In fact, in FIG. 4, finger 34 pushes forward the tooth of teeth 20*a* which it was behind, thereby driving top annular disc 22. Via its post 26, the latter then pushes coupling lever 59, which starts to pivot about its pivoting centre F. In turn, via its maneuvering arm 63, coupling lever 59 pushes sliding lever 40 which carries the third drive wheel 56 and its associated finger 58. Via the effect of this thrust, sliding lever 40 pivots about its pivoting centre A and finger 58 penetrates the toothing of the wheel 60 with twelve teeth of month star wheel 54. Finger 44 continues to rotate but without any effect on tooth 24*a* which moves away. As can be seen upon examining FIG. 4, jumper 28 is passing from one hollow between two successive teeth 20*a* to the hollow between the next two teeth 20*a* and momentarily passes over one of these teeth 20*a*. At this operating stage of the mechanism, the display is in an intermediate position between the "31$^{st}$" and the "1$^{st}$" of the following month.

We will now examine the change of month step with reference to FIG. 5. In this position, finger 34 has finished pushing one step forward the tooth 20*a*, which it was behind, and has driven date disc 16 through an additional step to make the display pass from the "31$^{st}$" to the "1$^{st}$" of the following month. It is thus the first day of month following a month with less than thirty-one days. It is thus a month of thirty-one days at the end of which there is no need to correct the display of the date disc 16. finger 44 is thus released from the second inner toothing 24 as will now be described in detail. Driven by wheel 56 which has itself been driven by wheel 36, finger 58 has moved month star wheel 54 one step forward, namely one twelfth of a revolution. During this last phase, the pivoting of month star wheel 54 is accompanied by the pivoting of bottom cam 66 and top cam 68. Beak 74 of lever 70 has followed the profile of bottom cam 66, whereas nose 72 is between two protruding portions of top cam 68. Lever 70, pivoting about its pivoting centre C, simultaneously drives sliding lever 48 while pivoting about its pivoting centre B, which causes the removal of finger 44 from the radius of toothing 24, such that at the end of the month of thirty one days, this finger 44 is released from said toothing 24 and cannot move date disc 16 through an additional step.

In FIG. 5, it is thus the first day of a month of thirty-one days following a month of less than thirty-one days. Finger 44 is in its final position in which it is released for the second inner toothing 24 of the top annular disc 22. It remains in this position for the whole of the month. At the end of the month of thirty one days, finger 34 passes date disc 16 from the "30$^{th}$" to the "31$^{st}$", then from the "31$^{st}$" to the "1$^{st}$" of the following month like a conventional calendar. Each time, finger 44 is actuated by instantaneous release system 76, but this has no effect on the date indication since finger 44 is released from the second inner toothing 24 of the top annular disc 22. During this second day, post 26 pushes sliding lever 40 via coupling lever 59. Via the effect of this thrust, lever 40 pivots about A and finger 58, penetrating the toothing of the twelve-toothed wheel 60 of month star wheel 54, moves said month star wheel 54 one step forward, namely one twelfth of a revolution. If one is passing from a month of thirty-one days to another months of thirty-one days (July/August and December/January), cams 66 and 68 will hold levers 70 and 48 in their position. If, on the other hand, one is passing to a month of less than thirty one days, nose 72 of lever 70 will climb onto protruding portion 68*b* and cause lever 48 to pivot such that finger 44 is in the radius of toothing 24 of disc 22, ready to move tooth 24*a* forward one step at the end of the month of less than thirty one days. This position is maintained during the entire month. On the "30$^{th}$" of the month, tooth 24*a* will be in the position illustrated in FIG. 3 and the cycle described will start again. It will be noted that during passage from the "1$^{st}$" to the "2$^{nd}$" post 26 completely overtakes coupling lever 59. The latter is then returned to its rest position via the effect of the thrust of spring 61 and is on the path of said post 26, ready to be actuated again by the latter when the current last day of the month passes to the first day of the next month.

Figure 10:
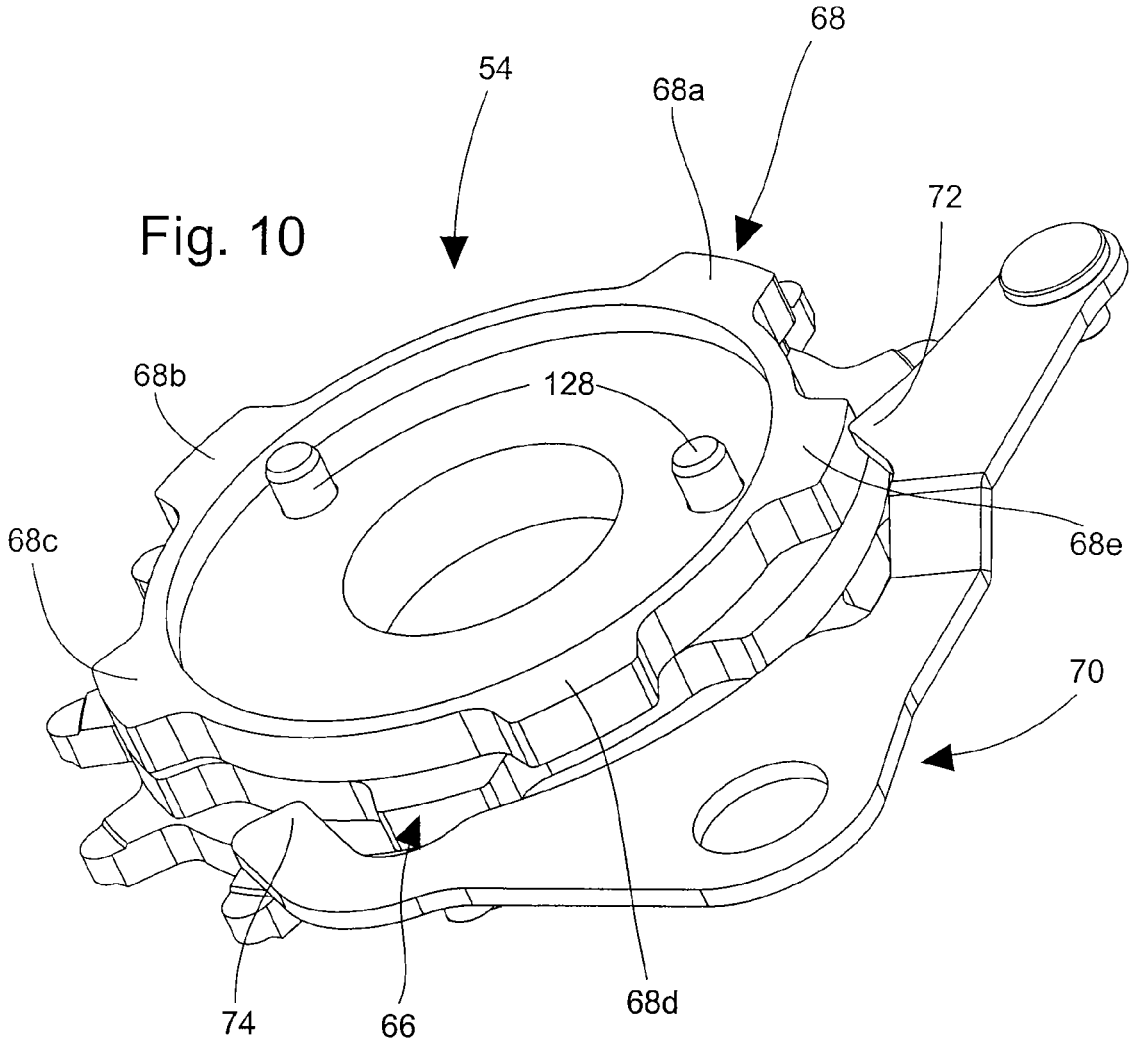
FIG. 10 is a perspective view of the lever cooperating with the month star wheel shown in FIG. 9.

It is clear from the foregoing that, during the months of less than thirty-one days, finger 44 is permanently on the path of tooth 24*a* of top annular disc 22. However, finger 44 only acts once per month since top annular disc 22 only has this single tooth 24*a*. however, during the months of thirty-one days, finger 44 is moved away from toothing 24, such that it has no effect on top annular disc 22. Further, the two cams 66 and 68 of month star wheel 54 materialise the succession of months of less than thirty-one days and months of thirty-one days. During a month of thirty-one days, beak 74 of lever 70 abuts on the tip of a protruding portion of bottom cam 66. Lever 70 pivots and brings finger 44 into an inactive position via sliding lever 48. During a month of less than thirty-one days, nose 72 of lever 70 abuts on the profile of top cam 68 and brings finger 44 into the active position. A perspective view of lever 70 is shown in FIG. 10.

Figure 11:
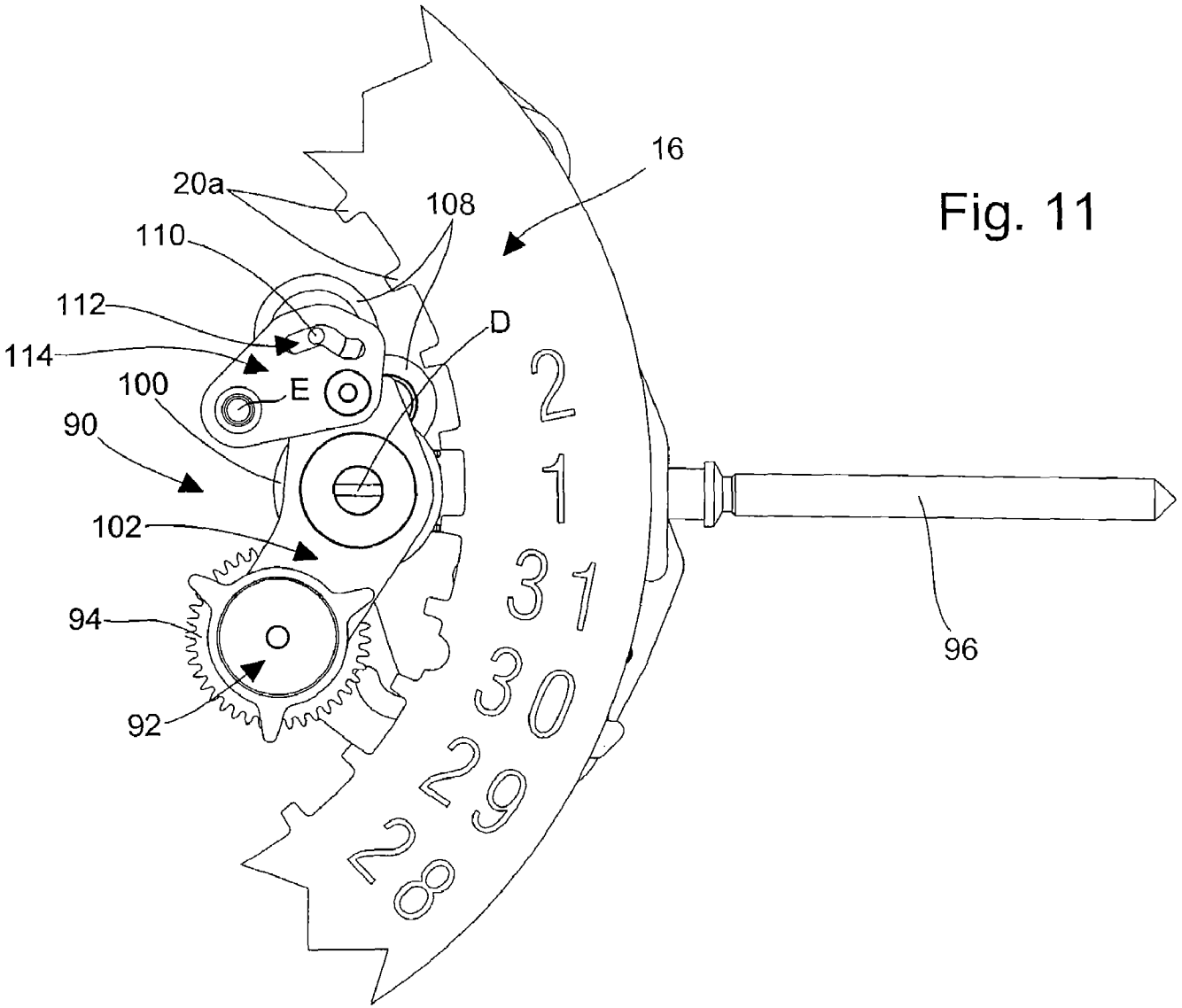
FIG. 11 is a plan view of the dial side of the quick correction system in the neutral position.

The annual calendar mechanism according to the invention also comprises a quick correction device illustrated in FIG. 11 and the following Figures. Designated as a whole by the general reference numeral 90, this quick correction device includes a corrector pinion 92 with three fingers friction driven by an intermediate wheel 94, which is itself driven by winding stem 96 via a sliding pinion 98 and a second intermediate wheel 100. A sliding lever 102 pivoting at D at the centre of the second intermediate wheel 100 carries the corrector pinion 92.

Figure 12:
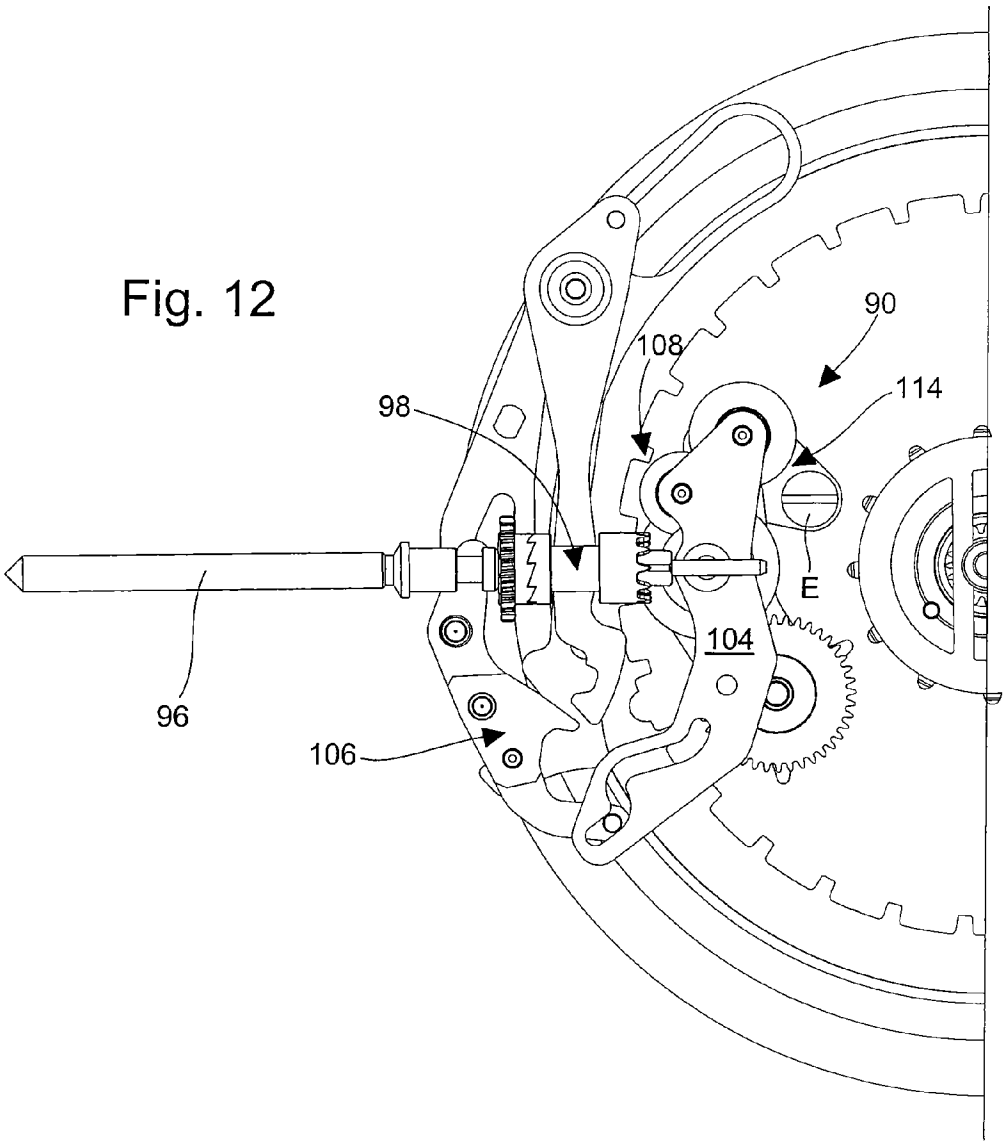
FIG. 12 is a plan view of the back cover side of the quick correction system of FIG. 11 again in the neutral position.
Figure 13:
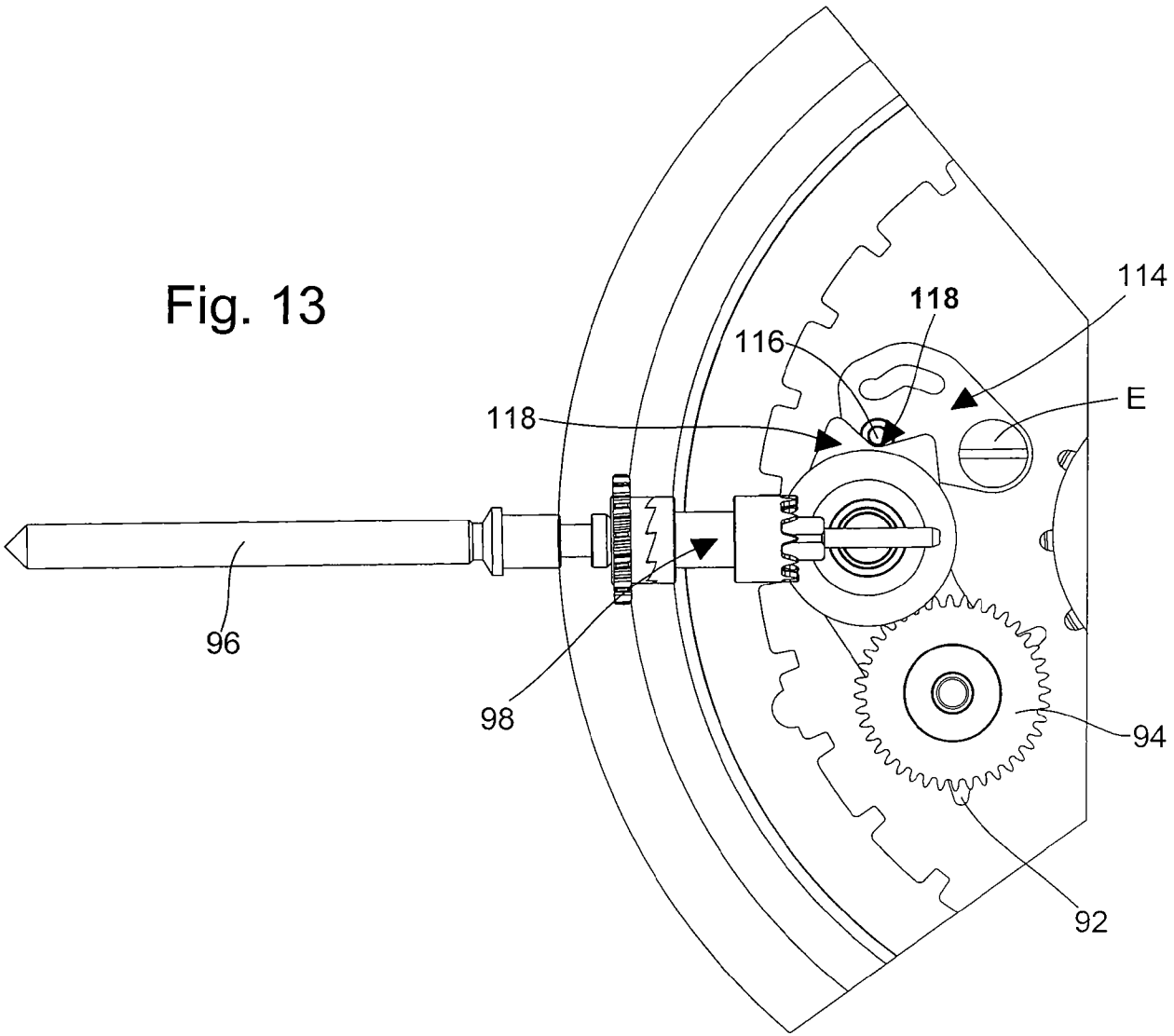
FIG. 13 is a similar view of that of FIG. 12 but in which certain pieces have been omitted in order to show the pieces located at lower levels.
Figure 14:
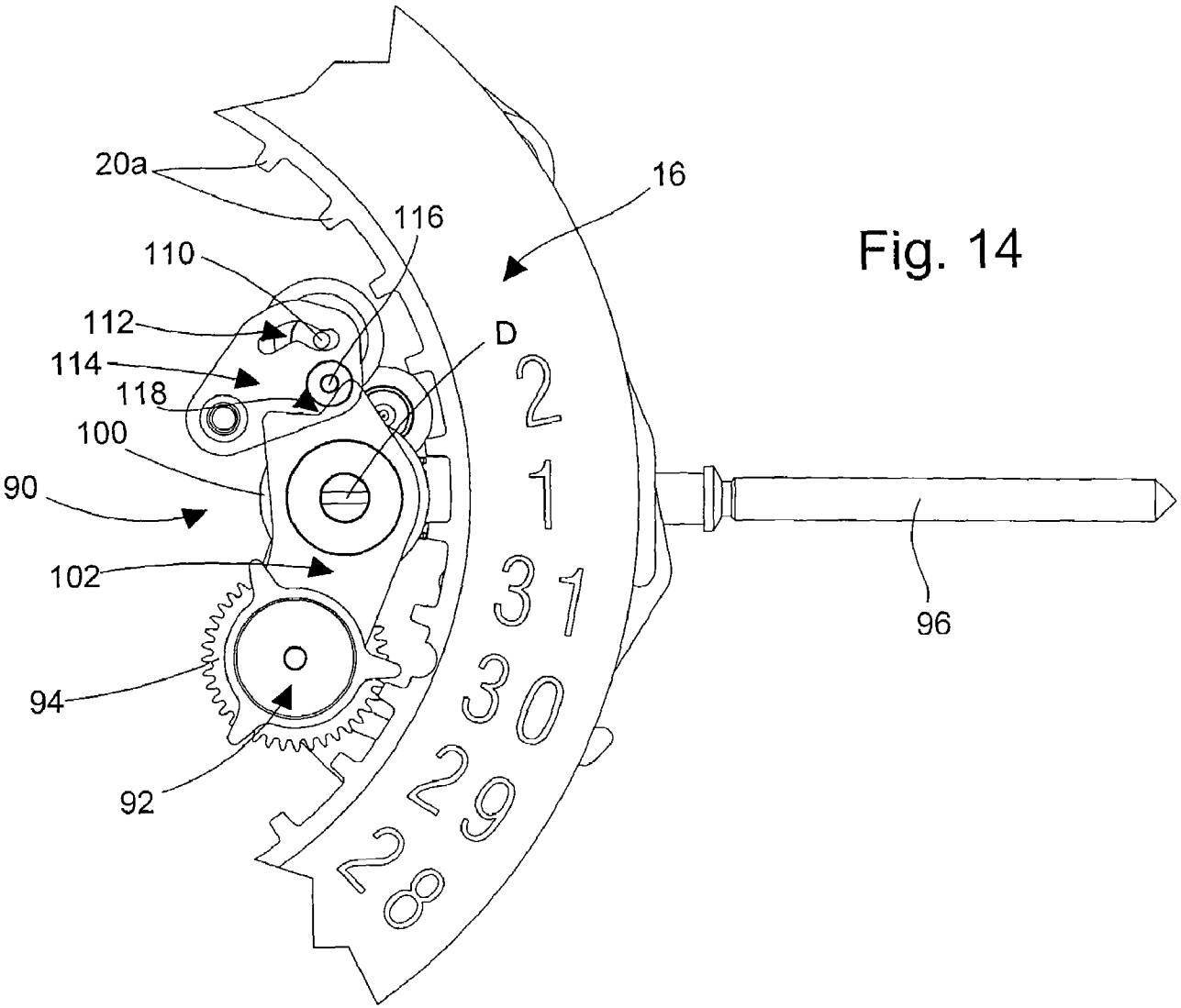
FIG. 14 is a plan view showing the corrector pinion of the quick correction system meshed with the toothing of the date disc.
Figure 15:
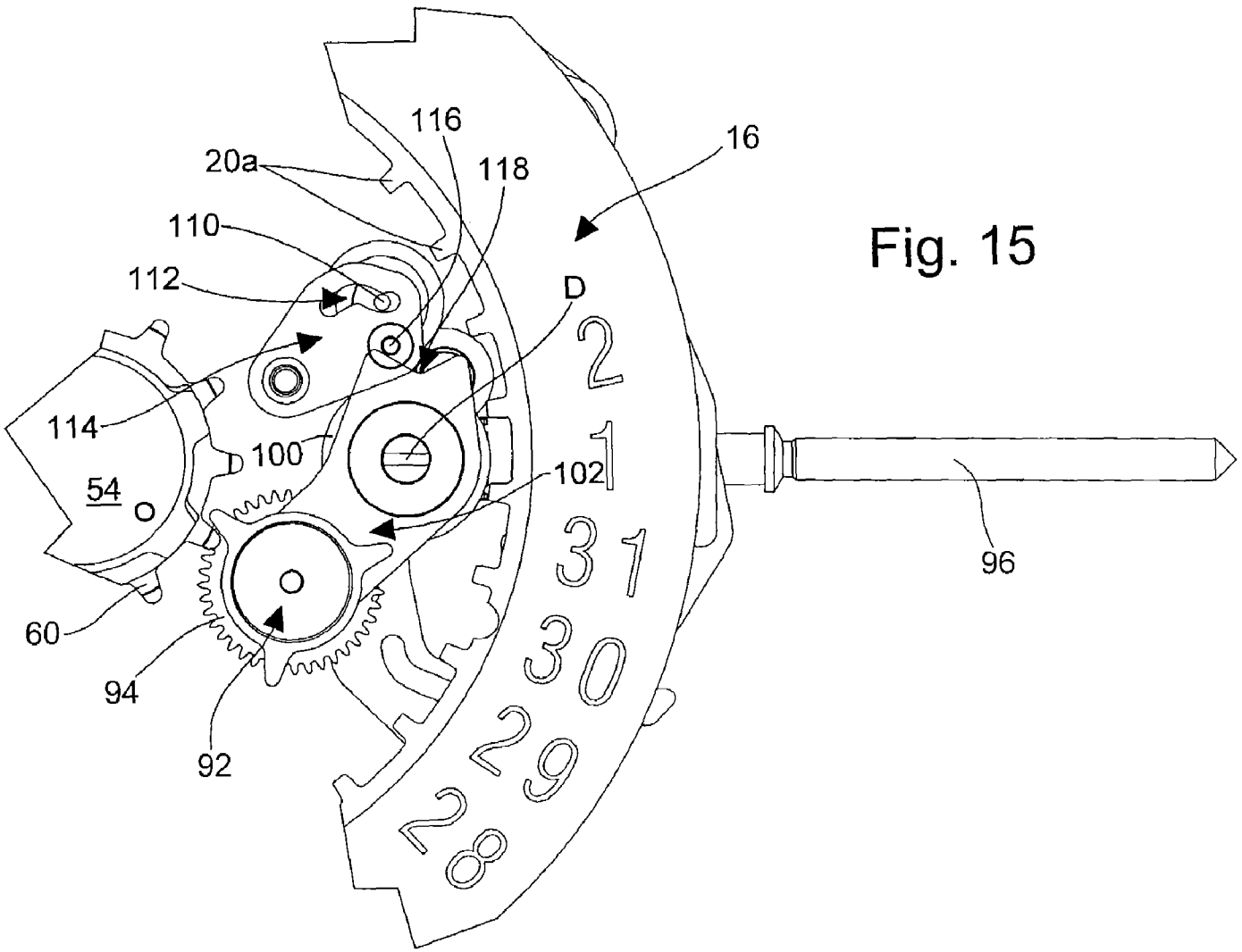
FIG. 15 is a plan view showing the corrector pinion of FIG. 14 meshed with the toothing of the month star wheel.
Figure 16:
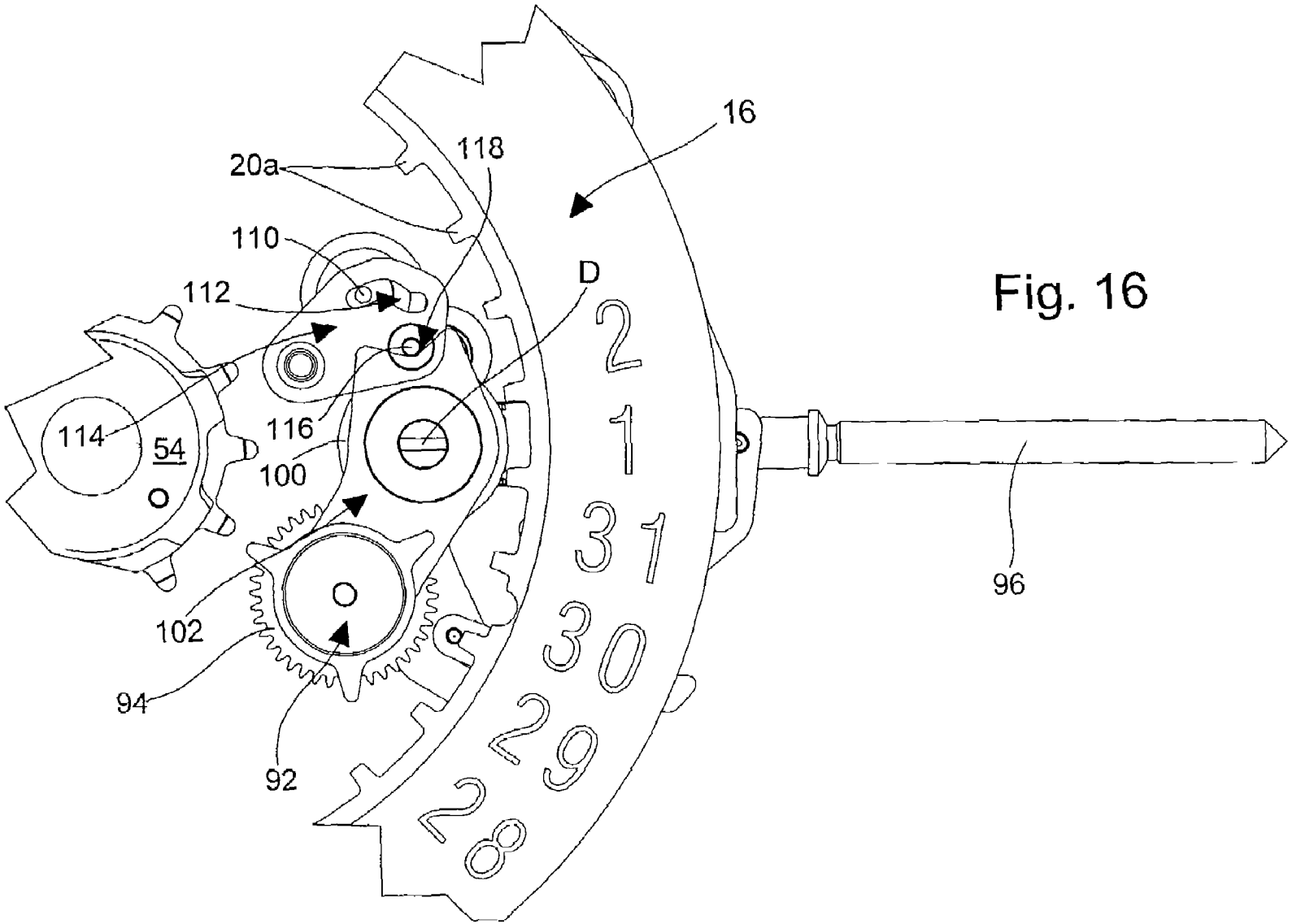
FIG. 16 is a plan view of the quick correction system in the watch time-setting position.

Quick correction device 90 is usually held in the neutral position in order not to disturb the proper operation of the annual calendar mechanism according to the invention. The control lever 104 of the time-setting mechanism of the movement can occupy three distinct positions as a function of the respective positions of winding stem 96 and a pull-out piece 106. In FIGS. 12 and 13, the control lever 104 is shown in the neutral position, with winding stem 96 pushed in. It carries the time-setting train 108, one pin 110 of which penetrates, on the dial side of the watch (not shown), a shaped slot 112 arranged in a lever 114. Lever 114 pivoting at E carries a post 116 which holds sliding lever 102 in place by lodging in a V-shaped cut out portion 118 of sliding lever 102.

When winding stem 96 is pulled out into the intermediate position, control lever 104 pivots and its pin 110 moves lever 114 and its post away from sliding lever 102. Sliding pinion 98 then drives intermediate wheels 94 and 100 and corrector pinion 92. Depending upon the direction of rotation of winding stem 96, sliding lever 102 pivots at D and corrector pinion 92 drives either date disc 16 by its first inner toothing 20, or month star wheel 54 by its twelve-toothed wheel 60. When winding stem 96 is in the time-setting position, control lever 104 pivots in the opposite direction and its pin 100 again holds lever 114 and its post 116 which lodges in V-shaped cut out portion 118.

Figure 17:
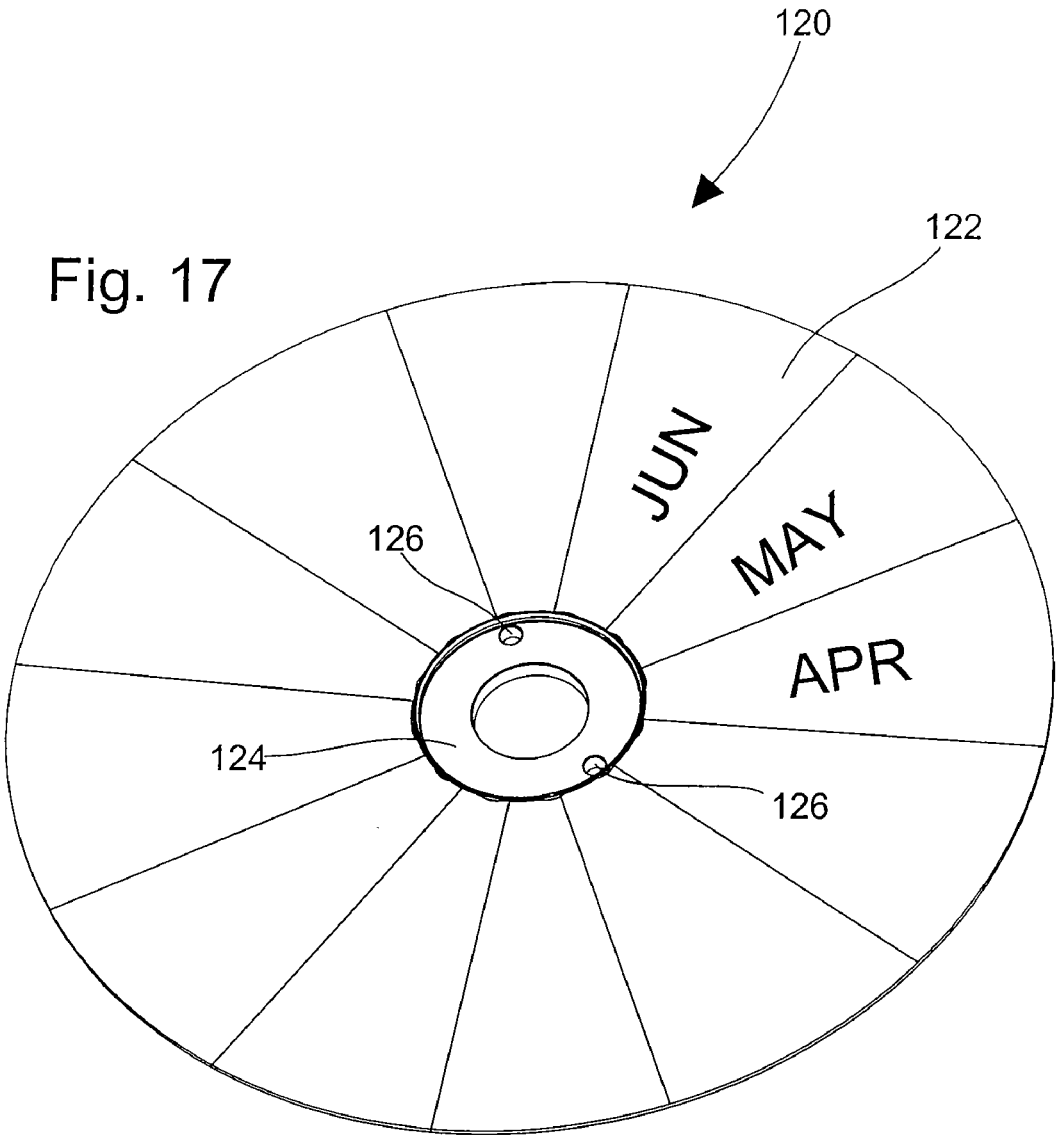
FIG. 17 is a perspective view of the month indicator disc.

The annual calendar mechanism according to the invention includes finally a month indicator shown in FIG. 17. Designated as a whole by the general reference numeral 120, this month indicator includes a disc 122 bearing the indication of the twelve months of the year. This indicator disc 122 is riveted onto a hub 124 provided with two holes 126 via which hub 124 is engaged on two corresponding posts 128 carried by month star wheel 54. The month indicator 120 thereby formed is held up by a key carried by a tube of the holding plate (not shown).

It goes without saying that the present invention is not limited to the embodiment that has just been described and that various simple alterations and variant can be envisaged by those skilled in the art without departing from the scope of the invention as defined by the annexed claims.

What is claimed is:

1. An annual calendar mechanism for a timepiece including a date disc to which thirty one figures are affixed each corresponding to an indication of a day of the month provided with a first inner toothing including thirty one teeth, a date drive wheel set, said wheel set including a finger driving the date disc through one step per day via one of the teeth of the first inner toothing in order to control the date display, said date disc including a second toothing, a correction drive wheel set able to cooperate with the second toothing to drive the date disc through an additional step at the end of the months of less than thirty one days, and a month star wheel arranged to be actuated at the end of each month and to complete one revolution per year, wherein this annual calendar mechanism includes a month drive wheel set provided for driving the month star wheel at the end of each month, said month drive wheel set being connected, via a gear train, to the date drive wheel set and to the additional correction drive wheel set, said month drive wheel set occupying a first position in which it has no effect on the month star wheel, such that the kinematic chain between the date disc and the month star wheel is broken, and a second position that it occupies only at the moment when the change of month occurs and in which it actuates the month star wheel so as to move it one step forward, such that a correction device can act on the date disc without any effect on the month star wheel and vice versa.

2. The annual calendar mechanism according to claim 1, wherein the date drive wheel set and the month drive wheel set are carried by a first sliding lever whose pivoting is controlled by a coupling lever, and in that the correction drive wheel set is carried by a second sliding lever whose pivoting is controlled by a lever that cooperates with the month star wheel.

3. The annual calendar mechanism according to claim 2, wherein the pivoting of the coupling lever is itself controlled by a post carried by the date disc, the effect of said movement causing the month drive wheel set to mesh with the month star wheel and move the latter forward one step at the end of each month, the lever pivoting and placing the correction drive wheel set on the path of the second toothing if the month to come is a month of less than thirty one days.

4. The calendar mechanism according to of claim 1, wherein the month drive wheel set includes a finger driving the month star wheel forward one step per month, and wherein the correction drive wheel set includes a finger driving the date disc through an additional step at the end of the months of less than thirty one days.

5. The annual calendar mechanism according to claim 2, wherein the month star wheel includes a wheel with twelve teeth and a staged month cam the month cam including five protruding portions corresponding to the five months of the year with less than thirty one days, the lever following the profile of the month cam by a beak.

6. The annual calendar mechanism according to claim 5, wherein the month star wheel further includes a cam, the lever following the profile of said cam via a nose.

7. The calendar mechanism according to claim 1, wherein the second toothing includes a single tooth.

8. The calendar mechanism according to claim 2, wherein the date drive wheel set includes a wheel that carries the finger and that is kinematically connected to a first drive wheel itself driven in rotation by an hour wheel wherein the correction drive wheel set includes a finger via which it drives the date disc via the second toothing, the finger being secured to a second drive wheel driven by the first drive wheel via an intermediate wheel which meshes with the wheel, and wherein the month drive wheel set includes a third drive wheel, which carries a finger via which said wheel set drives the month star wheel.

9. The calendar mechanism according to claim 8, wherein the date drive wheel set, the correction drive wheel set and the month drive wheel set are driven by an instantaneous release device.

10. The calendar mechanism according to claim 9, wherein the instantaneous release mechanism includes a release lever returned by a spring and which abuts via a beak against a cam, the wheel being secured to the cam via a pin that is free to move in a shaped aperture made in the drive wheel.

11. The calendar mechanism according to claim 1, wherein the date disc includes a bottom annular disc and a top annular disc that are staged, the bottom annular disc carrying the first inner toothing and the top annular disc carrying the second inner toothing.

12. The annual calendar mechanism according to claim 1, wherein the correction device comprises a corrector pinion carried by a sliding lever and driven by an intermediate wheel that is itself driven by a winding stem.

13. The annual calendar mechanism according to claim 12, wherein the sliding lever occupies a neutral position when the stem is in a winding or time-setting position via the action of a lever and a post that lodges in a cut out portion of said sliding lever, a first active date indication correction position and a second active month indication correction position depending upon the direction of rotation of the stem when the latter is in the correction position.

14. The annual calendar mechanism according to claim 1, wherein it includes a month indicator including a disc bearing the indication of the months of the year and secured to a hub via which it is mounted on the month star wheel.

* * * * *

UNITED STATES PATENT AND TRADEMARK OFFICE

CERTIFICATE OF CORRECTION

PATENT NO. : 7,218,576 B1
APPLICATION NO. : 11/558028
DATED : May 15, 2007
INVENTOR(S) : Alphonse Bron It is certified that error appears in the above-identified patent and that said Letters Patent is hereby corrected as shown below:

On Title Page, Item [73]
In the Assignee: Please delete "ETA SA Manufacture Horlogére Suisse" and insert therefore --ETA SA Manufacture Horlogère Suisse--.

Please insert Item [56] the Foreign Priority Application Information --EP 05024628.9 filed November 11, 2005--.

Signed and Sealed this

Fourteenth Day of August, 2007

JON W. DUDAS
*Director of the United States Patent and Trademark Office*